US012285142B2

(12) United States Patent
Bai

(10) Patent No.: US 12,285,142 B2
(45) Date of Patent: Apr. 29, 2025

(54) DISPENSER SYSTEM

(71) Applicant: Peter Bai, Placentia, CA (US)

(72) Inventor: Peter Bai, Placentia, CA (US)

( * ) Notice: Subject to any disclaimer, the term of this patent is extended or adjusted under 35 U.S.C. 154(b) by 0 days.

(21) Appl. No.: 18/353,811

(22) Filed: Jul. 17, 2023

(65) Prior Publication Data

US 2023/0355044 A1 Nov. 9, 2023

Related U.S. Application Data

(63) Continuation-in-part of application No. 18/308,515, filed on Apr. 27, 2023, which is a continuation-in-part of application No. 17/587,690, filed on Jan. 28, 2022, now Pat. No. 11,992,164, which is a continuation-in-part of application No. 16/740,146, filed on Jan. 10, 2020, now Pat. No. 11,297,983, which is a continuation-in-part of application No. 16/559,234, filed on Sep. 3, 2019, now Pat. No. 11,234,563.

(51) Int. Cl.
*A47K 5/12* (2006.01)

(52) U.S. Cl.
CPC ..... *A47K 5/1217* (2013.01); *A47K 5/1211* (2013.01)

(58) Field of Classification Search
CPC .... A47K 5/1217; A47K 2201/02; A47K 5/16; B67D 3/0032; B67D 47/061
USPC ..... 222/325, 518, 185.1
See application file for complete search history.

(56) References Cited

U.S. PATENT DOCUMENTS

| | | | | |
|---|---|---|---|---|
| 3,952,918 | A * | 4/1976 | Poitras | B67D 3/00 222/321.5 |
| 5,967,379 | A * | 10/1999 | Crossdale | B65D 39/06 141/351 |
| 7,299,956 | B2 * | 11/2007 | Haglund | B67D 3/0032 222/518 |
| 7,841,492 | B2 * | 11/2010 | Laible | B67D 3/0035 222/453 |
| 8,662,356 | B2 * | 3/2014 | Padain | A47K 5/1217 222/481.5 |
| 9,655,478 | B2 * | 5/2017 | Muderlak | A47K 5/1217 |
| 2012/0048891 | A1 * | 3/2012 | Hagleitner | A47K 5/16 222/138 |
| 2019/0374071 | A1 * | 12/2019 | Bai | A47K 5/122 |

* cited by examiner

*Primary Examiner* — Vishal Pancholi
*Assistant Examiner* — Robert K Nichols, II
(74) *Attorney, Agent, or Firm* — Clement Cheng

(57) ABSTRACT

A dispenser system has a base. A rear mount is formed on the base and the rear mount is configured to attach to a wall. A front cover is configured to fit over the base. The modular socket is formed in the base. The pump housing is configured to fit in the modular socket as a module. The pump is mounted inside the pump housing. A liquid container bracket retains a bracket socket. The liquid container bracket is mounted to the pump housing. A nozzle bracket retains a nozzle. The nozzle bracket is mounted to the pump housing. The nozzle is connected to the pump by an exit tubing. A liquid container removably connects to the bracket socket. Liquid in the liquid container flows through the bracket socket and then to an inlet tubing. The inlet tubing is then connected to the pump.

11 Claims, 9 Drawing Sheets

DISPENSER SYSTEM

The present invention is a continuation in part of copending parent non-provisional United States utility patent application entitled Wall Mount Dispenser by inventor Peter BAI Ser. No. 18/308,515 having a filing date of Apr. 27, 2023 the disclosure of which is incorporated herein by reference.

TECHNICAL FIELD

The present disclosure relates to a dispenser system such as a wall mount dispenser or a counter mount dispenser.

DISCUSSION OF RELATED ART

A variety of bathroom soap wall mount dispensers allow dispensing of liquid cleansers, alcohol such as hand sanitizer, hand soap and body soap. A variety of different United States patents have discussed dispensing, cartridge, for example in U.S. Pat. No. 8,348,105 to Wong, entitled Compact Automatic Homogenized Liquid Detergent Dispensing Device issued Jan. 8, 2003 provides a method for pumping liquid from a soap cartridge.

A counter mount dispensing system is in U.S. Pat. No. 7,752,087 to Rodenbaugh dated Jul. 13, 2010 entitled Product Dispensing System.

The disclosures of the cited references are incorporated herein by reference.

SUMMARY OF THE INVENTION

A wall mounted dispenser has a base. A rear mount is formed on the base and the rear mount is configured to attach to a wall. A front cover is configured to fit over the base. The modular socket is formed in the base. The pump housing is configured to fit in the modular socket as a module. The pump is mounted inside the pump housing. A liquid container bracket retains a bracket socket. The liquid container bracket is mounted to the pump housing. A nozzle bracket retains a nozzle. The nozzle bracket is mounted to the pump housing. The nozzle is connected to the pump by an exit tubing. A liquid container removably connects to the bracket socket. Liquid in the liquid container flows through the bracket socket and then to an inlet tubing. The inlet tubing is then connected to the pump.

The base further includes a cover hinge, wherein the front cover is hinge mounted to the cover hinge, wherein the cover hinge is located at a lower edge of the base, wherein the cover hinge receives the front cover. The modular socket further includes a first socket retainer. The modular socket further includes a second socket retainer. The battery tray opening is formed on the pump housing. A battery tray is mounted to the battery tray opening. A motherboard can receive a controller. The controller is electrically connected to a first sensor and a second sensor. The first sensor and the second sensor comprise a sensor assembly. The sensor assembly is mounted to the nozzle bracket. The sensor assembly is electrically connected to the controller and the sensor triggers operation of the motor.

The modular socket further includes a base clip for retaining the pump housing. The base clip is formed as a leaf spring. The leaf spring has a lower engaging edge that engages the pump housing along an engagement edge. The leaf spring is configured to be snap engaged but then releasable when a user depresses the leaf spring. The base clip formed as a leaf spring is plastic injection molded integrally with the base. The pump is retained to the pump housing when the liquid container is removed.

It is an object of the present invention to provide a liquid dispenser that does not require a pump connected to the liquid cartridge.

The liquid container has a liquid container lower wall. The liquid container lower wall has a liquid container outlet opening. The outlet valve gate controls a flow of the liquid from the liquid container. The outlet valve gate has a gate body. The gate body has an engaged position and a retracted position. The container adapter mounts to the liquid container outlet opening. The container adapter includes a container adapter outside sidewall and a container adapter inside sidewall joined at an adapter bend section. The gate body is configured to slide along the container adapter inside sidewall of the container adapter. An O-ring seal is mounted to the gate body. The O-ring seal engages a gate valve engagement of the container adapter at a gate valve guide that extends from the adapter shoulder. The gate body further includes a gate body base that abuts the socket shoulder of the bracket socket. The bracket socket further includes a socket well formed between a socket outside sidewall and a socket inside sidewall. The socket well retains a reservoir of liquid.

Figure 1:
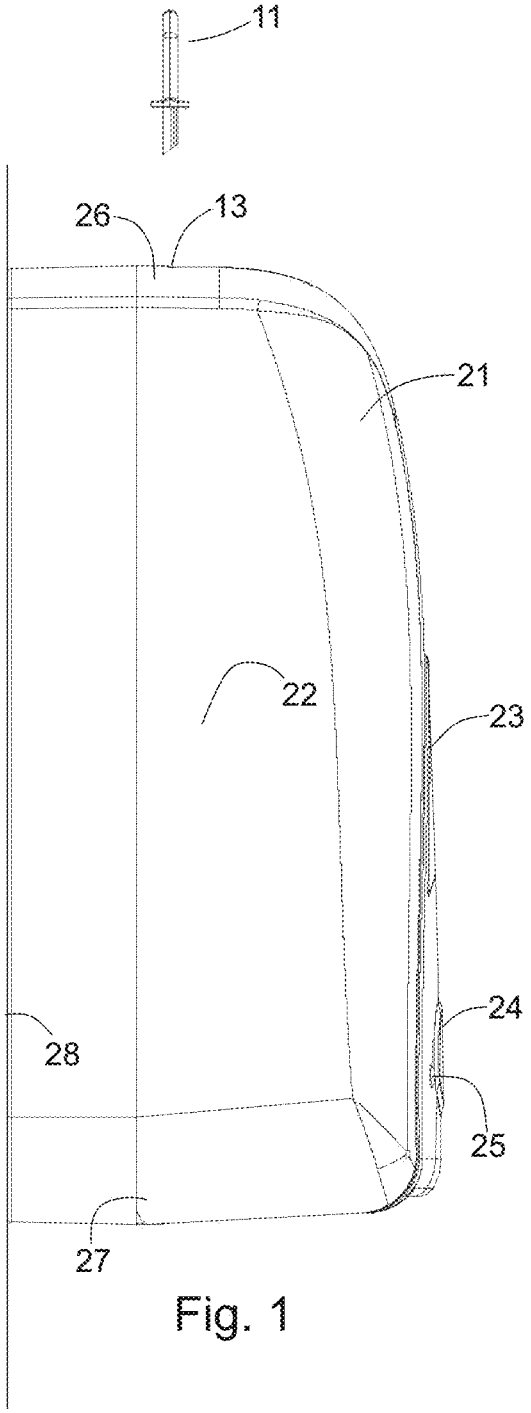
FIG. 1 is a side view of the wall mount dispenser.

The following call out list of elements can be a useful guide in referencing the element numbers of the drawings.

11 Key
12 Key Tooth Insert
13 Key Opening
14 Key Tooth Insert Tip
15 Latch Engagement Surface
16 Modular Socket
17 First Socket Retainer
18 Second Socket Retainer
21 Front Cover
22 Base
23 Window
24 Trim
Indicator Lens
26 Front Cover Latch
27 Cover Hinge
28 Rear Mount
29 Liquid Outlet Liquid Container
31 Liquid Container Outlet Opening
32 Liquid Container Bracket
33 Outlet Threads
34 Liquid
Hollow Portion
36 Outlet Valve Gate
37 Container Adapter
38 Outlet Valve Gate Spring
39 Outlet Valve Gate Gasket
Pump
41 Motor
42 Inlet Pump Nipple
43 Outlet Pump Nipple
44 Bracket Socket
45 Inlet Tubing
46 Exit Tubing
47 Nozzle
48 Motor Electrical
49 Bracket Socket Tube Connector
50 Sensor Assembly
51 First Sensor
52 Second Sensor
53 Sensor Board
55 Nozzle Mount
56 Nozzle Bracket
57 Mother Board
58 Controller
59 Mounting Bracket
60 Pump Housing
61 Pump Housing Base
62 Pump Bracket
63 Pump Housing Cover
64 Battery Tray
65 Battery Tray Opening
66 Indicator Light
67 Control Button
68 Lower Bracket Mount
69 Upper Bracket Mount
70 Valve Gate Pushing Stem
71 Base Retainer
72 Leaf Spring Portion Of Base Retainer
73 Leaf Spring Lower Engaging Edge
74 Leaf Spring Slot
100 socket passage
101 socket step corner
170 socket extension wall
171 socket shoulder
172 socket well
173 socket outside sidewall
174 socket well bottom
274 socket inside sidewall
175 socket opening
176 socket upper edge
177 tubing flow channel
178 extension flow channel
179 socket well gap
80 outlet valve gate opening
81 upper gate stopper
82 gate stopper arm
83 gate head extension
84 spring channel
85 gate body
86 gate body base
87 gate body channel
88 O-ring seal
89 base inside corner
90 container adapter outside sidewall
91 container adapter inside sidewall
92 adapter shoulder
93 gate valve guide
94 gave valve engagement edge
95 adapter bend section
96 adapter inside thread
97 adapter outside sidewall step
98 container neck ring
99 container lower wall
200 liquid flow

DETAILED DESCRIPTION OF THE EMBODIMENTS

Figure 2:
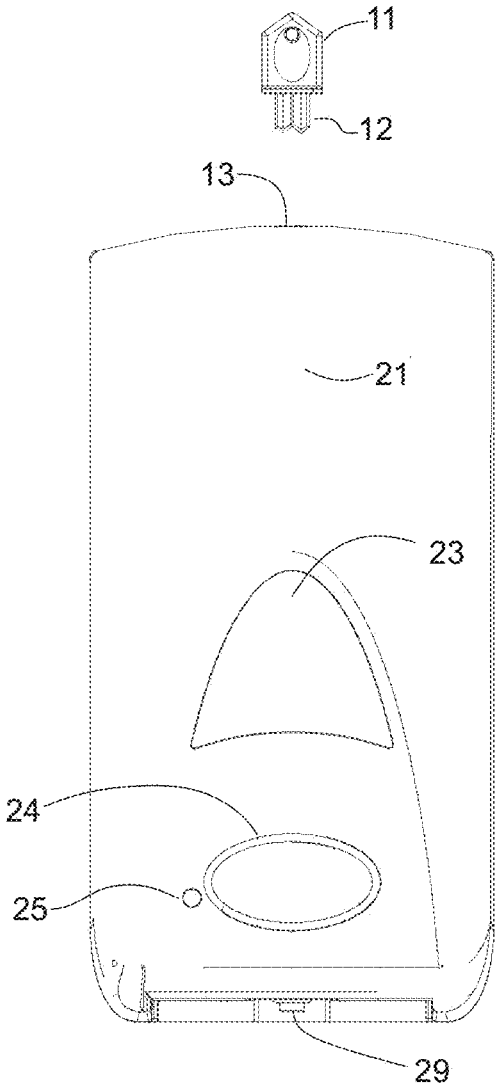
FIG. 2 is a front view of the wall mount dispenser.

As shown in FIGS. 1-2, the side view of the dispenser and a front view of the dispenser show a base 22 having a rear mount 28 connected to a wall. The front cover 11 is connected to the base 22 at a cover hinge 27 which is at a lower edge of the base 22 and the lower edge of the front cover 21. A window 23 is formed on the front cover 21. A trim piece can be mounted to the front cover 21 which can provide a modular oval-shaped indicia that can receive an identifying distributor or source such as a trademark applied to the external surface of the trim piece 24. Adjacent to the trim piece 24, the indicator lens 25 brings light from an LED inside the front cover 21 for providing an indication to a user. A key 11 has a key tooth insert 12 which fits into a key opening 13 that triggers a latch for opening the front cover 21. The liquid outlet 29 which dispenses the soap is located at a lower portion of the front cover 21. The front cover 21 can have an opening at a lower portion which allows the liquid outlet 29 to protrude from the lower portion of the front cover 21.

Figure 3:
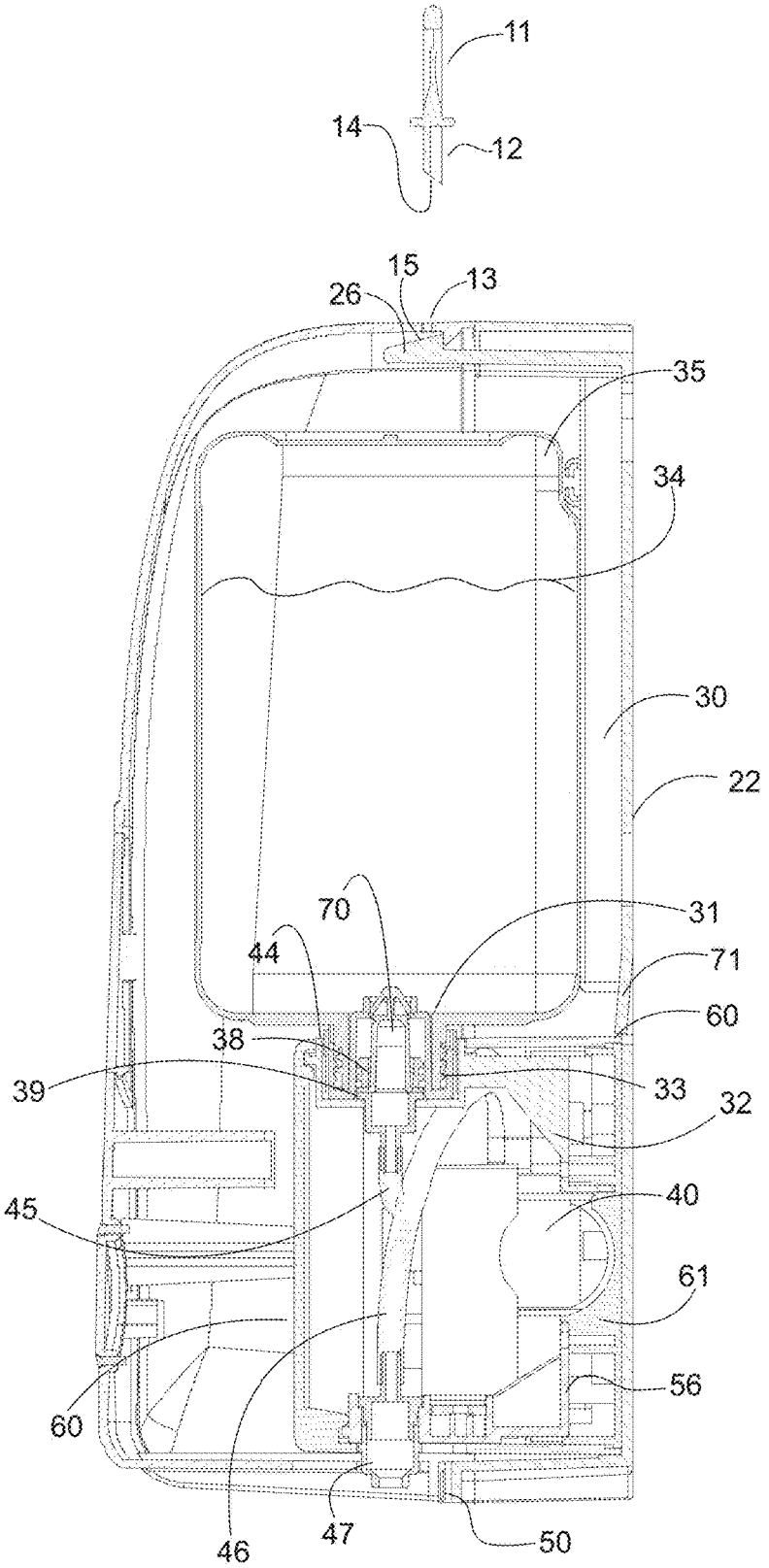
FIG. 3 is a cross-section diagram of the wall mount dispenser.

As seen in FIG. 3, a cross-section of the present invention shows the key 11 with the key tooth insert 12 having a key tooth insert tip 14. The key tooth insert tip 14 is shaped as a pointed and angled tip which engages the front cover latch 26 through the key opening 13. The key tooth insert tip 14 abuts the latch engagement surface 15 formed on the front cover latch 26. The front cover latch 26 is underneath the key opening 13. The front cover latch 26 has a latch angled profile which slopes upwardly from front to back. The key tooth insert tip 14 has a tip angled profile which slopes downwardly from front to back.

A liquid container 30 holds liquid 34 in a hollow portion 35 of the liquid container 30. The liquid container 30 is underneath the front cover latch 26. The liquid container 30 can be a flexible plastic container that fits in the front cover 21. The liquid container 30 has outlet threads 33 that retain an outlet valve gate 36. The outlet valve gate 36 is mounted to the liquid container outlet opening 31 and the outlet valve gate 36 controls liquid 34 flowing through the liquid container outlet opening 31. The outlet valve gate ring 38 biases the outlet valve gate 36 to a closed position when the liquid container 30 is removed from the liquid container bracket 32. The outlet valve gate gasket 39 seals the outlet valve gate 36 against the liquid container outlet opening 31.

The liquid container bracket 32 has a bracket socket 44. The bracket socket receives the liquid container outlet opening 31. The valve gate pushing stem 70 pushes the outlet valve gate 36 into open position and biases against the outlet of valve gate spring 38. The valve gate pushing stem 70 is hollow and connects to the inlet tubing 45. The liquid passes through the valve gate pushing stem 70 and into the inlet tubing 45 after a user loads the liquid container 30 into the liquid container bracket 32. The inlet tubing passes to a pump 40 which then pumps the liquid to an outlet tubing or exit tubing 46. The pump 40 is mounted to a pump housing base 61. The pump housing base 61 has a nozzle bracket 56. The nozzle bracket 56 retains the nozzle 47. Soap or a liquid such as alcohol can be dispensed to the user from the nozzle 47. The pump housing 60 includes the pump housing base 61 and retains the pump 40, liquid container bracket 32, and the nozzle bracket 46. The pump housing 60 modularly attaches to the base 22 at a base retainer 71. The base retainer 71 can be formed as a base clip. The pump housing 60 also has a sensor assembly 50 for sensing the user.

Figure 4:
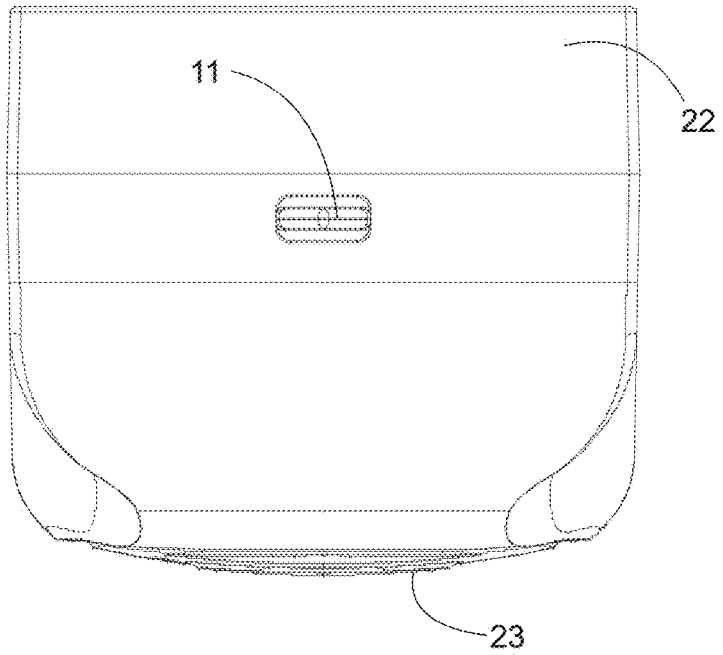
FIG. 4 is a top view of the dispenser.
Figure 5:
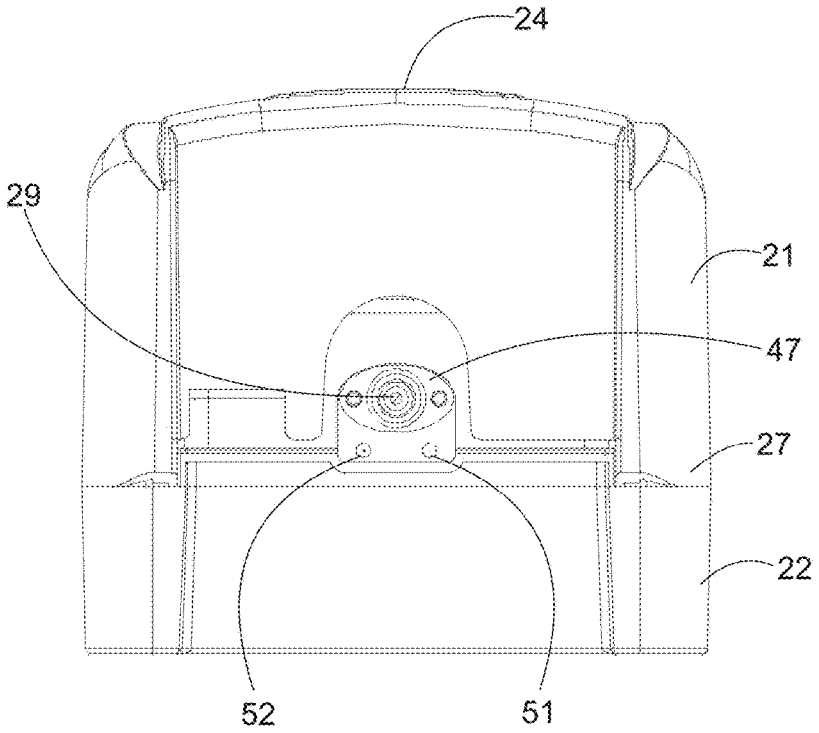
FIG. 5 is a bottom view of the wall mount dispenser.

As seen in FIGS. 4-5, a top view of the dispenser and a bottom view of the dispenser show that the key 11 is pressed onto the dispenser from a top portion adjacent to the base 22. A bottom view of the dispenser shows that the liquid outlet 29 is mounted to the nozzle 47. The nozzle may have a pair of screws that connect to the nozzle bracket 56 between the front cover 21 and the base 22. The first sensor 51 and the second sensor 52 are preferably mounted to the nozzle bracket 56 near and adjacent to the cover hinge 27.

Figure 6:
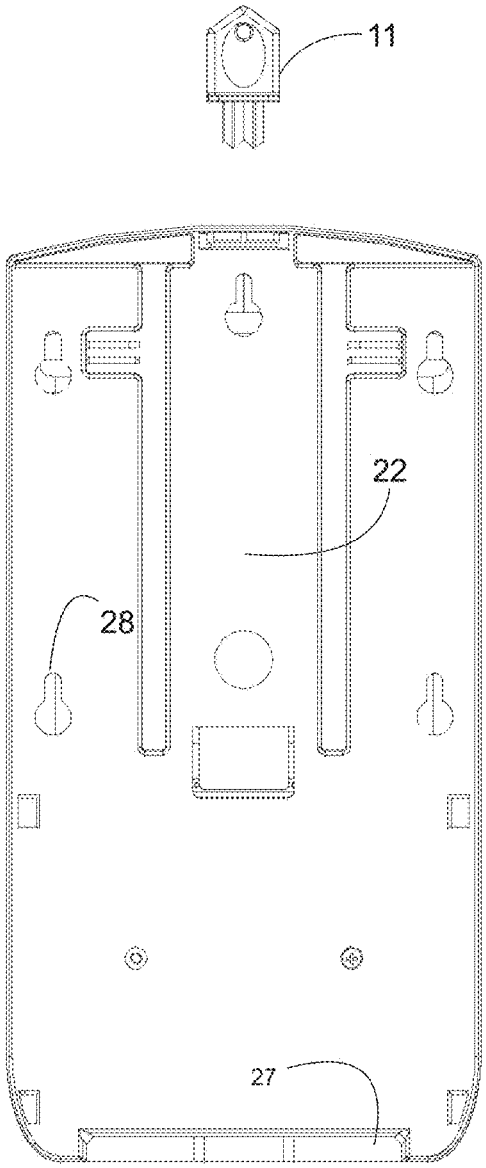
FIG. 6 is a rear view of the wall mount dispenser.
Figure 7:
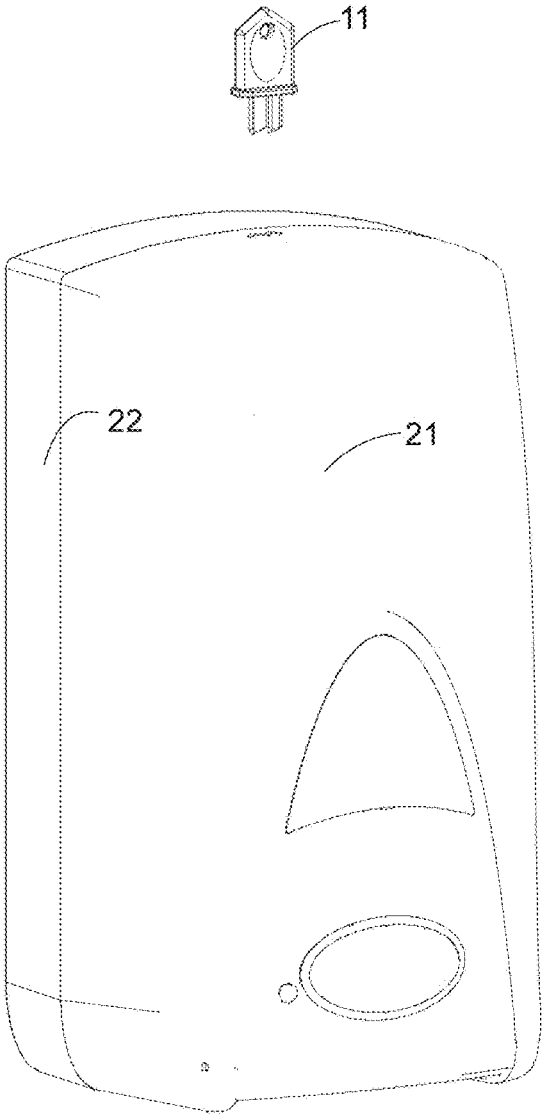
FIG. 7 is a perspective view of the wall mount dispenser.

As seen in FIGS. 6-7, the rear mount 28 can be formed on the base 22. The rear mount 28 can be formed of openings that can receive screws from the front side. The mount openings are preferably located in the upper portion of the base 22. Preferably, a middle top opening provides an initial anchor location which then allows the user to install four separate screws. In this way, the device is securely mounted to the wall. A perspective view of the present invention shows that the housing is generally a rounded rectangular prism shape.

Figure 8:
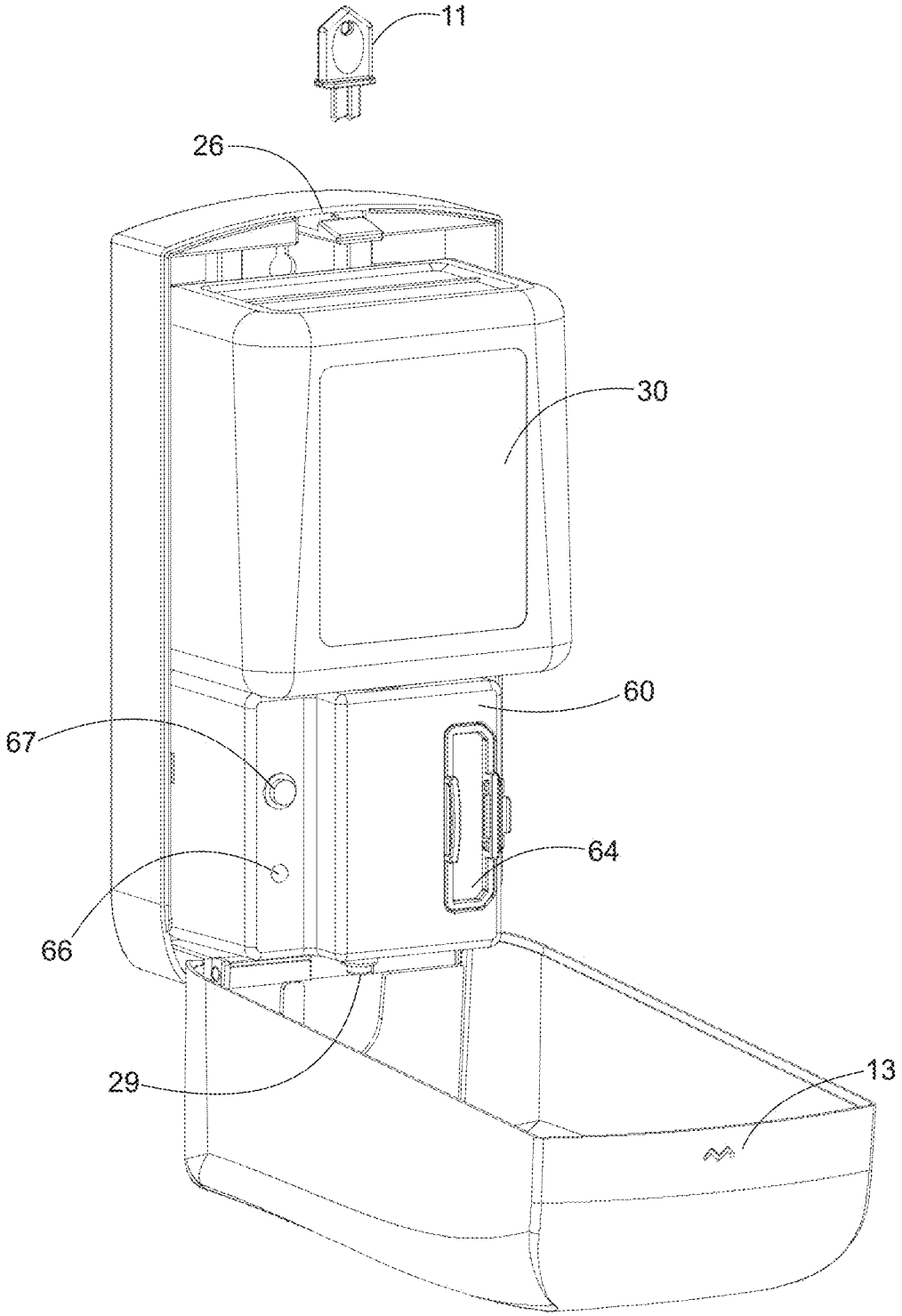
FIG. 8 is a perspective view of the dispenser with the cover open.

As seen in FIG. 8, the liquid container 30 sits on the pump housing 60. The pump housing 60 has a control button 67 for activating different functions. An indicator light 66 illuminates the indicator lens 25. A battery tray 64 allows the user to replace the batteries without removing the pump housing 60. Also, the liquid outlet 29 is exposed for cleaning when the key 11 opens the front cover latch 26. To replace the pump housing module 60, the user can remove the liquid container and 30, then press the base retainer 71 inwardly to slide out the pump housing module 60.

Figure 9:
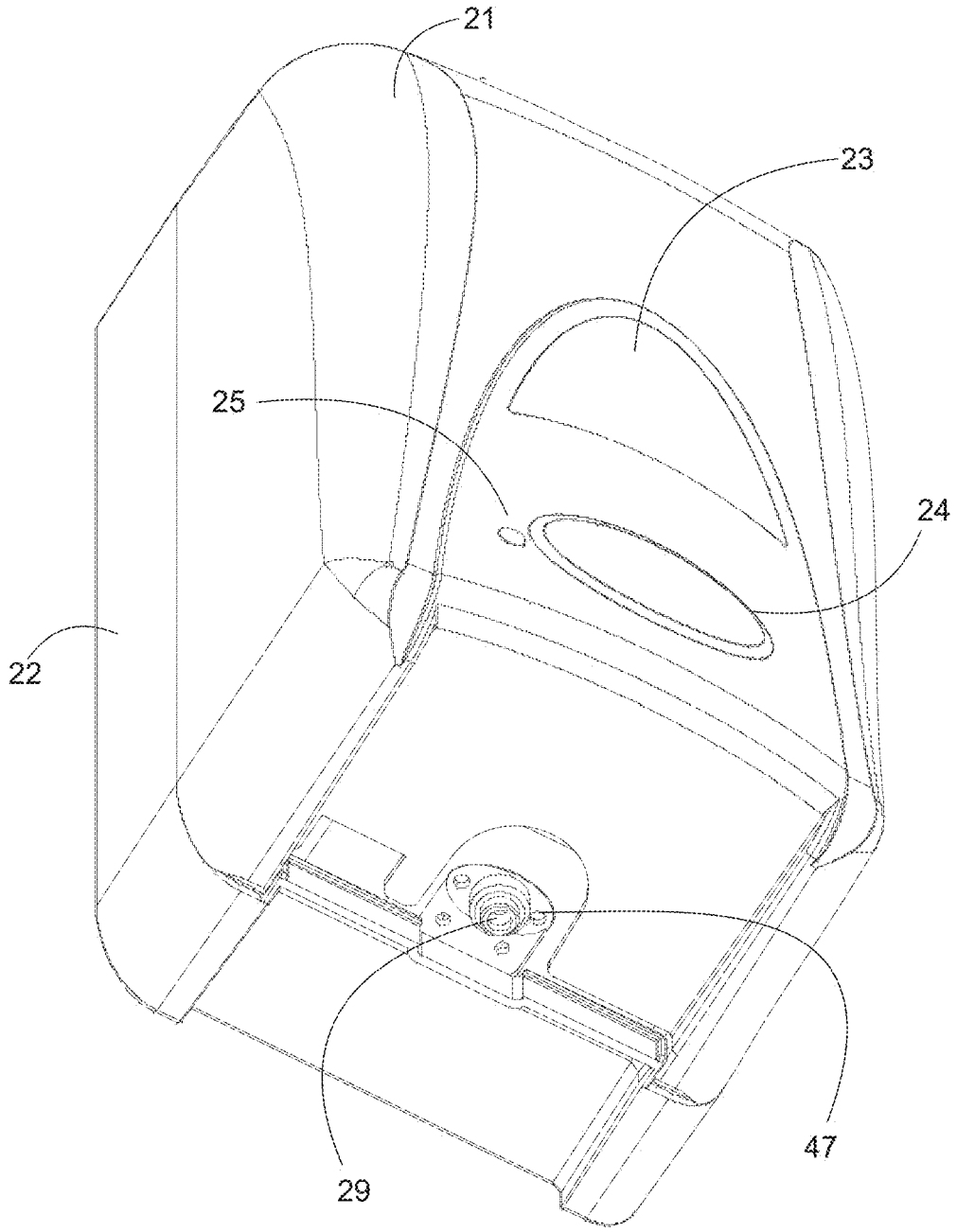
FIG. 9 is a bottom perspective view of the dispenser.

As seen in FIG. 9, the liquid outlet 29 is mounted to the nozzle 47 and has an unobstructed clearance in case the dispenser is dispensing foam.

Figure 10:
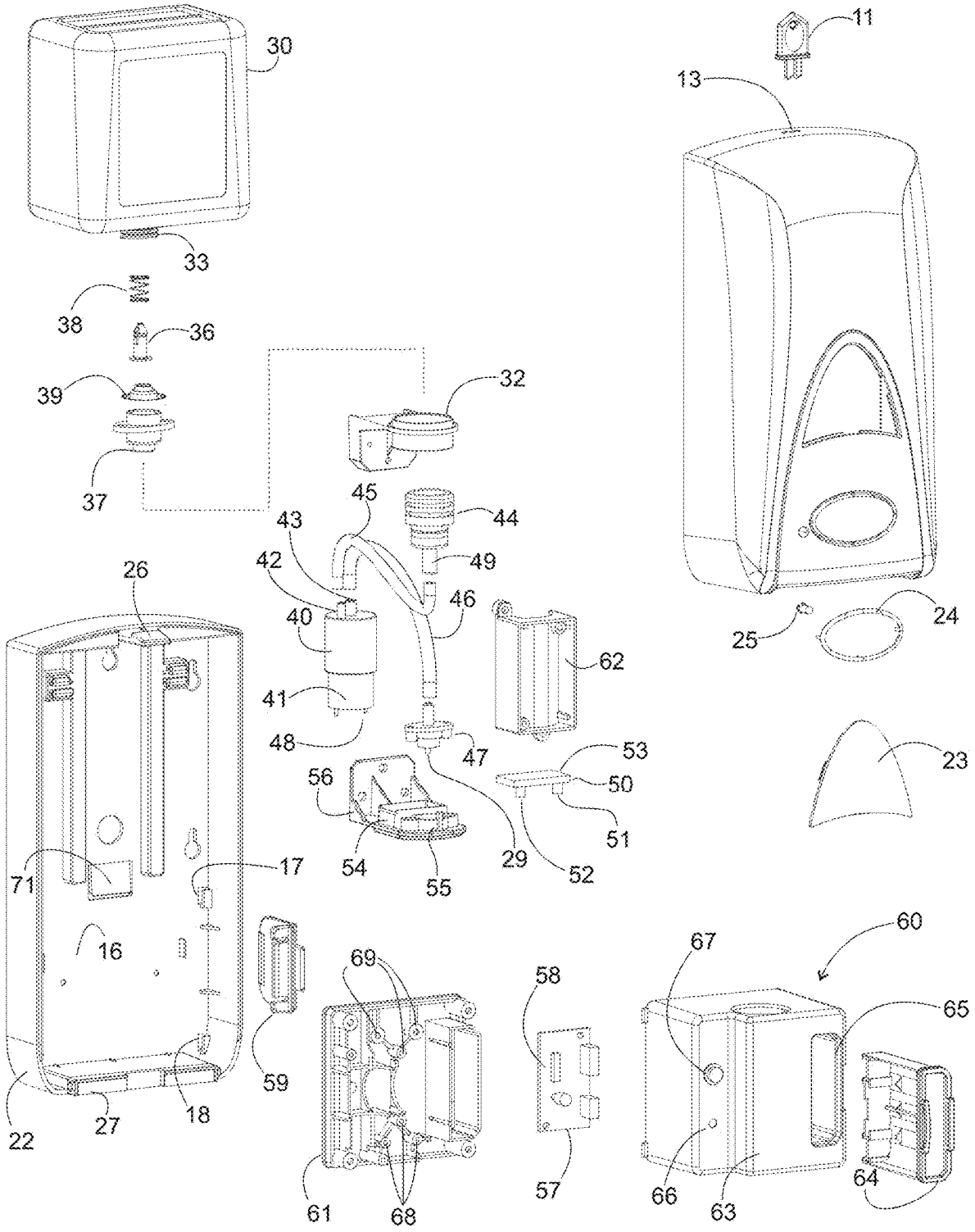
FIG. 10 is an exploded view of the dispenser.

As seen in FIG. 10, a detailed exploded view of the present invention shows all the major parts of the dispenser. The liquid container 30 has outlet threads 33. The outlet valve gate spring 38 biases the outlet valve gate 36 in a closed position against the outlet valve gate gasket 39. The container adapter 37 aligns the outlet valve gate 36 so that it is depressed to an open position when mounted to the bracket socket 44. The liquid container bracket 32 holds the bracket socket 44. The bracket socket 44 has a bracket socket tube connector 49 that connects the bracket socket 44 to the inlet tubing 45. The inlet tubing 45 connects to the pump 40 at an inlet pump nipple 42. The pump 40 has an inlet pump nipple 42 and an outlet pump nipple 43. The outlet pump nipple 43 is connected to the exit tubing 46. The exit tubing 46 is connected to the nozzle 47. The nozzle 47 has a liquid outlet 29 mounted to it.

The motor 41 in the pump 40 has motor electrical contacts 48. The motor electrical contacts are connected to the motherboard 57 and the controller 58. The controller 58 is configured to dispense liquid by activating the motor electrical contacts 48 when the controller 58 receives an input signal from the sensor assembly 50. The sensor assembly 50 is mounted in the nozzle mount 55. The nozzle mount 55 has a sensor board mount 54 which receives the sensor board 53. The sensor board mount 54 is formed as a slot with two small circular openings at the bottom of the slot. The first sensor 51 and the second sensor 52 peeks through the two small circular openings at the bottom of the slot. The sensor assembly 50 including the sensor board 53 is electrically connected to the motherboard 57 which has the controller 58.

The nozzle 47 also fits in a nozzle mount 55. The nozzle mount 55 is also formed as a slot with an opening at the bottom for the liquid outlet 29. The upwardly extending sidewalls of the nozzle mount 55 and the upwardly extending sidewalls of the sensor board mount 54 retain the nozzle is a rigid configuration to the first sensor 51 and the second sensor 52.

The pump bracket 62 can have a concave shape with a lower mounting opening and an upper left mounting opening for connecting and retaining the pump 42 the pump housing base 61. The pump housing base 61 has a lower bracket mount 68 and an upper bracket mount 69. Both the lower bracket mount and the upper bracket mount can be formed as integrally plastic injection molded screw studs for receiving three screws each in a triangular configuration. The indicator light 66 can be illuminated by an LED that is mounted to the motherboard 57.

The pump housing cover 63 fits with the pump housing base 61 to enclose the pump 40, tubing, pair of brackets and battery tray 64. The battery tray 64 fits into a battery tray opening 65. The battery tray opening 65 can have electrical contacts for transmitting electrical power to the controller 58. The pump housing 60 also has a round circular opening for the bracket socket 44.

Once the pump housing 60 is completely assembled with all of the parts, it becomes a modular unit. For repair and replacement, the pump housing module can fit onto a first socket retainer 17 and a second socket retainer 18. Optionally, a mounting bracket 59 can mount the pump housing 60 to the modular socket 16. The modular socket 60 is formed to receive the pump housing 60. As an added securing feature, the base retainer 71 formed as a base clip can be formed as a resilient plastic leaf spring that has a downwardly extending engaging edge that engages the pump housing 60 one the pump housing 60 snaps onto the plastic leaf spring downwardly extending engaging edge 73. For releasing the pump housing 60, a user can depress the base retainer 71. Thus, the pump housing 60 can be modularly removed and replaced without tools except for the key 11 which fits into the key opening 13.

The modular socket 16 further includes a base retainer 71 such as a base clip for retaining the pump housing. The base clip is formed as a leaf spring 72. The leaf spring has a lower engaging edge 73 that engages the pump housing along an engagement edge. The leaf spring 72 is configured to be snap engaged but then releasable when a user depresses the leaf spring. The base clip can be formed as a leaf spring 72 that is plastic injection molded and integrally formed with the base when the injected plastic is resilient and flexible. The leaf spring 72 can be mounted in a leaf spring slot 74 that is formed on the base 22.

The liquid container is preferably disposable. The liquid container is not connected to the pump. The liquid container is pumpless and provides foam liquid via a liquid flow 200 of soap or sanitizer fluid.

Figure 11:
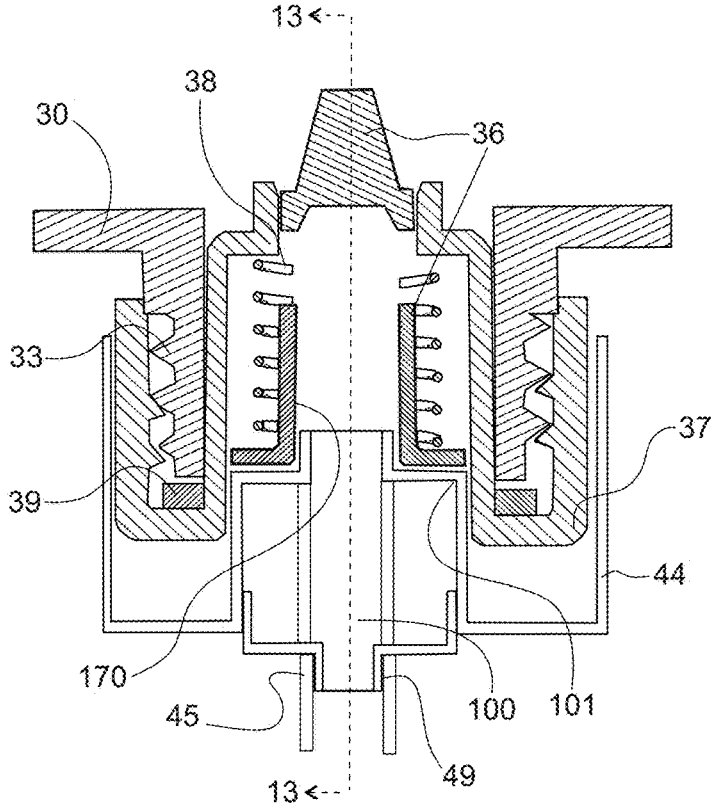
FIG. 11 is a front cross-section view of the liquid container in a disengaged position.
Figure 12:
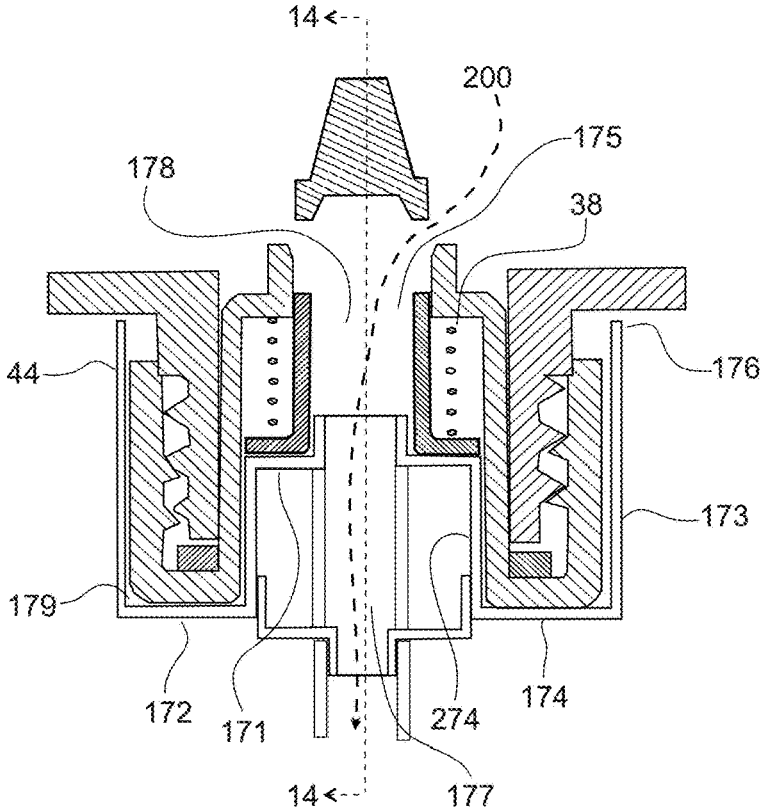
FIG. 12 is a front cross-section view of the liquid container in an engaged position.

As seen in FIGS. 11-12, the liquid container 30 has an opening having a neck that has container thread 33. The container thread 33 bias the neck to the gasket 39. The gasket 39 is sandwiched between the container thread 33 and the container adapter 37. The container adapter 37 can have a one-way engagement to prevent loosening of the container adapter 37 such as by engaging wedge edges. The outlet valve gate spring 38 biases an outlet valve gate 36 that slides along an interior portion of the container adapter 37. The outlet valve gate 36 releases liquid from the liquid container 30 through the socket passage 100 in a liquid flow 200. The bracket socket 44 has a socket step corner 101 that engages the outlet valve gate 36 to open the outlet valve gate 36 when the liquid container 30 is placed in the bracket socket 44 of the container adapter 37.

The bracket socket 44 is adapted to receive the container adapter 37. The socket extension wall 170 extends upwardly from the socket shoulder 171. The socket shoulder 171 rises above a socket well 172. The socket outside sidewall 173 and the socket inside sidewall 274 bound the outside and the inside of the container adapter 37. The socket well bottom 174 retains a small reservoir of liquid that leaks whenever the bracket socket 44 receives a new container adapter 37 such as during liquid container changes. The liquid container does not have a pump and is changed as a cartridge. The socket well 172 sends surplus liquid to the socket opening 175 as the socket well 172 is lower than a socket upper edge 176 of the socket outside sidewall 173. The socket well gap 179 is formed between the socket well bottom 174 and the container adapter 37.

The socket extension wall 170 terminates at a socket opening 175 where the extension flow channel 178 receives a full of liquid from the container 30 and passes it to the inlet tubing 45 that is connected to the socket passage 100. The socket upper edge 176 has a larger diameter than the socket opening 175. The tubing flow channel 177 communicates with the extension flow channel 178. The extension flow channel 178 can be formed on a sidewall of the outlet valve gate such as at an outlet valve gate rectangular opening. The vertical dimensions of FIGS. 11-12 are exaggerated for clarity.

Figure 13:
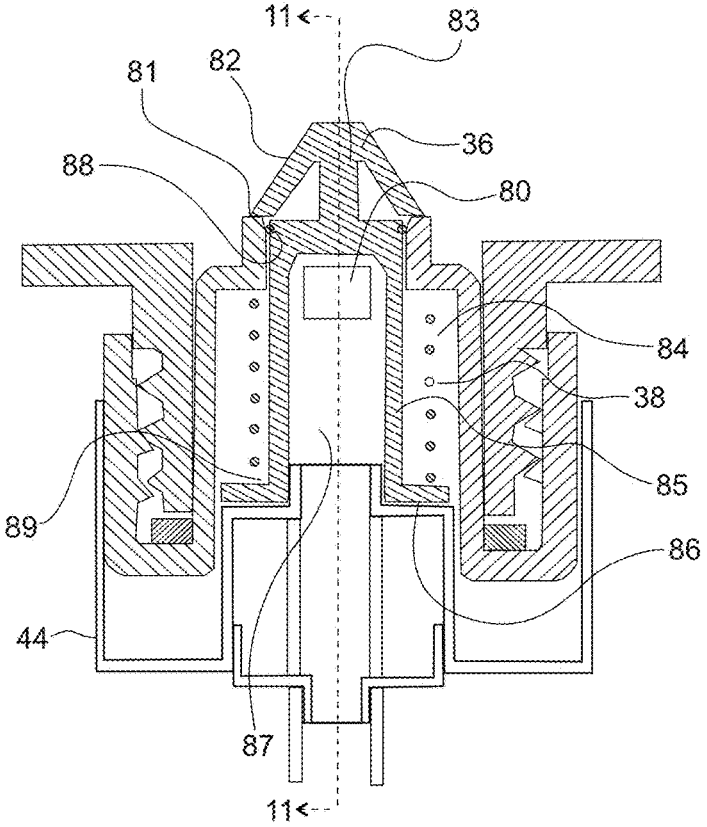
FIG. 13 is a side cross-section view of the liquid container in a disengaged position.
Figure 14:
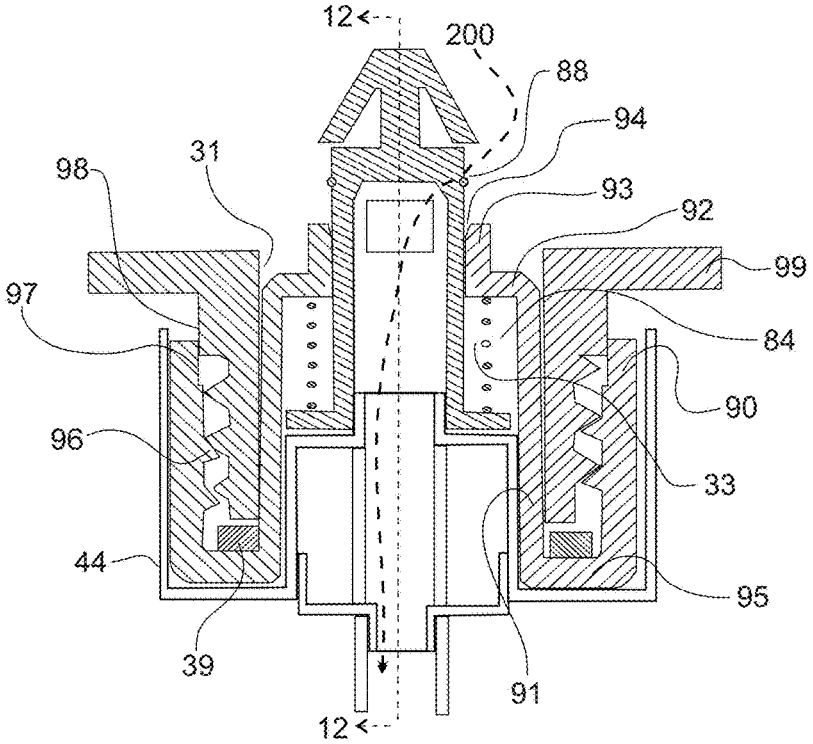
FIG. 14 is a side cross-section view of the liquid container in an engaged position.

As seen in FIGS. 13-14, the outlet valve gate opening 80 is formed as the outlet valve gate rectangular opening on a sidewall of the outlet valve gate 36. The outlet valve gate 36 has an upper gate stopper 81 formed at the end of a gate stopper arm 82. The gate stopper arm 82 is mounted to the gate head extension 83. The gate stopper arm 82 is a flat sheet of flexible plastic. The upper gate stopper 81 abuts the container adapter 37. The O-ring seal 88 seals the container adapter 37 to the outlet valve gate 36. The O-ring seal 88 can be mounted in an O-ring seal groove formed at an upper portion of the outlet valve gate 36. The gate head extension 83 can be formed as a flat planar protrusion that receives the gate stopper arm 82. The gate stopper arm 82 can also be formed as a flat planar protrusion. The gate stopper arm 82 is preferably angled and the outlet valve gate 36 is preferably vertical. The gate body 85 has a gate body base 86 formed as a flange that extends outwardly from a lower portion of the gay body 85. The gate body base 86 retains the outlet valve gate spring 38 in a spring channel 84. The spring channel 84 is formed between the gate body 85 and the container adapter such as the container adapter inside sidewall 91. The upper gate stopper 81 provides a limit to the retraction of the outlet valve gate 36 from the container 30. The spring channel 84 is preferably annular.

The gate body 85 is preferably integrally formed with the gate body base 86, the gate head extension 88 and the gate stopper arm 82 as part of one outlet valve gate 36. The spring channel 84 retains the helical spring, namely the outlet valve gate spring 38 so that the gate body base 86 is biased away from the adapter shoulder 92. When the O-ring seal 88 is biased into the seated position, the O-ring seal 88 engages the gate valve engagement edge 94. The gate body channel 87 receives liquid from the outlet valve gate opening 80. The gate body 85 has a cylindrical hollow central portion that forms the gate body channel 87.

The spring channel 84 formed by the cave body 85 and the gate body base 86, circumscribe the gate body channel 87. The O-ring seal 88 acts as a gasket that engages to the gate valve guide 93. The gate valve guide 93 is formed as a short tubular member. The base inside corner 89 of the gate body base 86 defines a lower portion of the spring channel 84.

The container adapter 30 has a container adapter outside sidewall 90 that connects to a container adapter inside sidewall 91 at an adapter bend section 95. The liquid container outlet opening 31 receives the container adapter inside sidewall 91. The adapter inside thread 96 engages the container thread 33 and the adapter bend section 95 provides a clipping force that biases the container thread 33 to the adapter inside thread 96. The adapter shoulder 92 extends inwardly from the container adapter inside sidewall 91, and the gate valve guide 93 extends upwardly from an inside edge of the adapter shoulder 92. The gate valve guide 93 has a gate valve engagement edge 94. The gate valve engagement edge 94 engages the O-ring seal 88.

The adapter shoulder 92 forms a right angle bend that encloses the outlet valve gate spring 38 in the spring channel 84. The spring channel 84 is bounded at an upper edge by the adapter shoulder 92 and at a lower edge by the gate body base 86. The spring channel 84 is bounded at an outer edge by the container adapter inside sidewall 91 and at an inside edge by the gate body 85. The adapter bend section 95 retains the annular gasket 39. As the gate body 85 slides up and down in the spring channel 84 and the gate valve guide 93, the gate opens and closes.

The adapter outside sidewall step 97 engages the container neck ring 98 and may provide a retaining force to prevent the container adapter 37 from loosening its threads. The gate valve engagement edge 94 is preferably slightly beveled. The O-ring seal 88 is preferably resilient and pliable such that it conforms to the slightly beveled surface of the gate valve engagement edge 94 to provide a seal when the soap container cartridge is not engaged to the bracket socket 44. Preferably, the gate valve guide 93 forms a tight seal with the gate body 85 to prevent any leaking. The container lower wall 99 of the container 30 is horizontal in orientation.

The invention claimed is:

1. A wall mounted dispenser comprising:

a. a base;

b. a rear mount formed on the base, wherein the rear mount is configured to attach to a wall;

c. a front cover, wherein the front cover is configured to fit over the base;

d. a pump housing, wherein the pump housing is configured to fit in the base;

e. a pump powered by a motor, wherein the pump is mounted inside the pump housing;

f. a liquid container bracket retaining a bracket socket, wherein the liquid container bracket is mounted to the pump housing, wherein the pump is retained to the pump housing when the liquid container is removed, wherein the liquid container is pumpless;

g. a liquid container, wherein the liquid container has a liquid container lower wall, wherein the liquid container lower wall has a liquid container outlet opening;

h. an outlet valve gate, wherein the outlet valve gate controls a flow of the liquid from the liquid container, wherein the outlet valve gate has a gate body, wherein the gate body has an engaged position and a retracted position; and i. a container adapter, wherein the container adapter mounts to the liquid container outlet opening, wherein the container adapter includes a container adapter outside sidewall and a container adapter inside sidewall joined at an adapter bend section, wherein the container adapter further includes an adapter shoulder, wherein the adapter shoulder forms a spring channel with the gate body, wherein an outlet valve gate spring is formed as a helical spring retained in the spring channel, wherein the spring channel is bounded between the gate body and the container adapter;

j. a neck formed on the liquid container outlet opening, wherein the neck has container thread, wherein the container thread bias the neck to a gasket mounted on the container adapter, wherein the outlet valve gate spring biases an outlet valve gate that slides along an interior portion of the container adapter, wherein the outlet valve gate releases liquid from the liquid container through a socket passage in a liquid flow, wherein the bracket socket has a socket step corner that engages the outlet valve gate to open the outlet valve gate when the liquid container is placed in the bracket socket of the container adapter, wherein the bracket socket is adapted to receive the container adapter; and k. a socket extension wall, wherein the socket extension wall extends upwardly from the socket shoulder, wherein the socket shoulder rises above a socket well, wherein the socket outside sidewall and the socket inside sidewall bound the outside and the inside of the container adapter, wherein the socket well bottom forms a small reservoir that can capture liquid leaks when the bracket socket receives a new container adapter such as during liquid container changes.

2. The wall mounted dispenser of claim 1, wherein the base further includes a cover hinge, wherein the front cover is hinge mounted to the cover hinge, wherein the cover hinge is located at a lower edge of the base, wherein the cover hinge receives the front cover.

3. The wall mounted dispenser of claim 1, further including a battery tray opening formed on the pump housing, and further including a battery tray mounted to the battery tray opening.

4. The wall mounted dispenser of claim 1, further including a motherboard with a controller, wherein the controller is electrically connected to a first sensor and a second sensor, wherein the first sensor and the second sensor comprise a sensor assembly, wherein the sensor assembly is mounted to the nozzle bracket, wherein the sensor assembly is electrically connected to the controller wherein the sensor triggers operation of the motor.

5. The wall mounted dispenser of claim 4, wherein the base clip is formed as a leaf spring.

6. The wall mounted dispenser of claim 5, wherein the leaf spring has a lower engaging edge that engages the pump housing along an engagement edge.

7. The wall mounted dispenser of claim 6, wherein the leaf spring is configured to be snap engaged but then releasable when a user depresses the leaf spring.

8. The wall mounted dispenser of claim 1, wherein the gate body is configured to slide along the container adapter inside sidewall of the container adapter, wherein the socket extension wall terminates at a socket opening that aligns to the liquid container outlet opening where the extension flow channel receives a flow of liquid from the container and passes it to the inlet tubing that is connected to the socket passage, wherein the socket upper edge has a larger diameter than the socket opening, wherein the tubing flow channel communicates with the extension flow channel, wherein the extension flow channel is formed on a sidewall of the outlet valve gate.

9. The wall mounted dispenser of claim 8, further including an O-ring seal mounted to the gate body, wherein the O-ring seal engages a gate valve engagement of the container adapter at a gate valve guide that extends from the adapter shoulder.

10. The wall mounted dispenser of claim 8, wherein the gate body further includes a gate body base, wherein the gate body base abuts the socket shoulder of the bracket socket.

11. The wall mounted dispenser of claim 8, wherein the bracket socket further includes a socket well formed between a socket outside sidewall and a socket inside sidewall, wherein the socket well retains a reservoir of liquid.

* * * * *